United States Patent [19]

Kanegae et al.

[11] 4,456,831

[45] Jun. 26, 1984

[54] FAILSAFE FOR AN ENGINE CONTROL

[75] Inventors: Hidetoshi Kanegae; Yoshihisa Kawamura, both of Yokosuka; Masao Nakajima, Atsugi; Seishi Yasuhara, Yokosuka, all of Japan

[73] Assignee: Nissan Motor Company, Limited, Yokohama, Japan

[21] Appl. No.: 339,153

[22] Filed: Jan. 13, 1982

[51] Int. Cl.[3] ..... F02D 11/10; F02B 77/00

[52] U.S. Cl. ..... 290/38 R; 180/179; 192/3 R; 123/327; 364/511

[58] Field of Search ..... 290/30 R, 38 R, 40 R, 290/48, DIG. 3, DIG. 5, DIG. 6, DIG. 7, DIG. 8; 123/327, 339, 586, 480, 490, 102; 364/511, 431.12, 431.07; 180/179, 335; 192/3 R

[56] References Cited

U.S. PATENT DOCUMENTS

| | | | |
|---|---|---|---|
| 2,749,450 | 6/1956 | Wellington, Jr. | 290/40 R |
| 2,768,331 | 10/1956 | Cetrone | 290/40 R |
| 3,699,932 | 10/1972 | Aono et al. | 123/490 |
| 4,020,802 | 5/1977 | Hattori et al. | 123/490 |
| 4,024,408 | 5/1977 | Coleman et al. | 290/38 R X |
| 4,049,957 | 9/1977 | Kera et al. | 123/479 X |
| 4,080,537 | 3/1978 | Bucher | 290/38 R |
| 4,098,242 | 7/1978 | Anderson | 123/102 |
| 4,153,014 | 5/1979 | Sweet | 123/490 |
| 4,200,080 | 4/1980 | Cook et al. | 290/38 R X |
| 4,201,922 | 5/1980 | Douglas et al. | 290/38 R |
| 4,212,066 | 7/1980 | Carp et al. | 123/480 X |
| 4,213,180 | 7/1980 | Marchak et al. | 123/480 X |
| 4,213,181 | 7/1980 | Carp et al. | 123/490 X |
| 4,214,306 | 7/1980 | Kobayashi | 123/480 X |
| 4,237,838 | 12/1980 | Kinugawa et al. | 123/327 |
| 4,312,315 | 1/1982 | Takase | 123/479 |

*Primary Examiner*—J.V. Truhe
*Assistant Examiner*—Terry Flower
*Attorney, Agent, or Firm*—Schwartz, Jeffery, Schwaab, Mack, Blumenthal & Koch

[57] ABSTRACT

A start-up failsafe system for an engine control system monitors a command signal and the corresponding feedback signal for a fuel injection rate control servo device when the starter motor switch is closed. If the feedback signal and the command signal differ by more than a predetermined amount, the failsafe system acts to prevent operation of the starter motor.

11 Claims, 5 Drawing Figures

FAILSAFE FOR AN ENGINE CONTROL

BACKGROUND OF THE INVENTION

The present invention relates to an internal combustion engine, and more particularly to a failsafe system for detecting malfunctions of a device which controls the amount of fuel or intake air supplied to an engine, and for taking safety measures when a malfunction occurs.

In a device which controls the fuel injection rate employed in, or the flow rate of intake air supplied to, an engine such as a diesel engine or a spark ignition engine, a servo control system has generally been used, which uses an actuator, such as a servomotor, for the controlled device, and a detector for sensing the position or state of the controlled device to feed back a signal indicative of the state of the device to be used to further refine the controlled state of the system.

In such a servo control system, the servomotor is required to adjust rapidly to correct its speed and direction during its operation. Furthermore, it is normally mounted directly on the engine of an automotive vehicle and therefore the environment in which it is used is very severe with regard to vibrations and/or heat. Thus malfunctions due to motor seizure or interruption of electrical connection leads are liable to occur.

When such malfunctions occur in prior art control systems, the device actuated by the servomotor will suddenly be operating without proper control. It is possible in such a case for the engine speed to increase to damaging or even dangerous levels.

For example, in a system in which the fuel injection rate employed in a diesel engine is controlled by a servomotor, the starting of the engine can be reliably achieved by automatically increasing the fuel injection rate before or during the operation of the starter motor. When the servo control system including a servomotor malfunctions, however, an insufficient amount of fuel may be injected during enging starting so that the engine cannot start, or the fuel injection rate may remain increased even after the engine has entered its steady-state operation so that the engine might run at an excessively high speed.

SUMMARY OF THE INVENTION

It is therefore an object of the present invention to provide a failsafe mode of operation which detects malfunctions of an engine control system before starting and stops the control system before start-up when it malfunctions.

In order to attain the above and other objects, and in accordance with the invention a failsafe system for an engine control system is provided which invention generates a command signal for adjusting by a predetermined value a controller for a controlled device during engine start-up, determines that the control system is functioning properly when the feedback signal from means for detecting the state of the controlled device has changed by the predetermined value according to the command signal, and prevents engine starting when the feedback signal fails to change.

BRIEF DESCRIPTION OF THE DRAWINGS

The above and other objects, features and advantages of the present invention will be apparent from the following description of a preferred embodiment thereof, taken in conjunction with the accompanying drawings in which.

DETAILED DESCRIPTION OF THE PREFERRED EMBODIMENT

Diesel Engine Control

Figure 1:
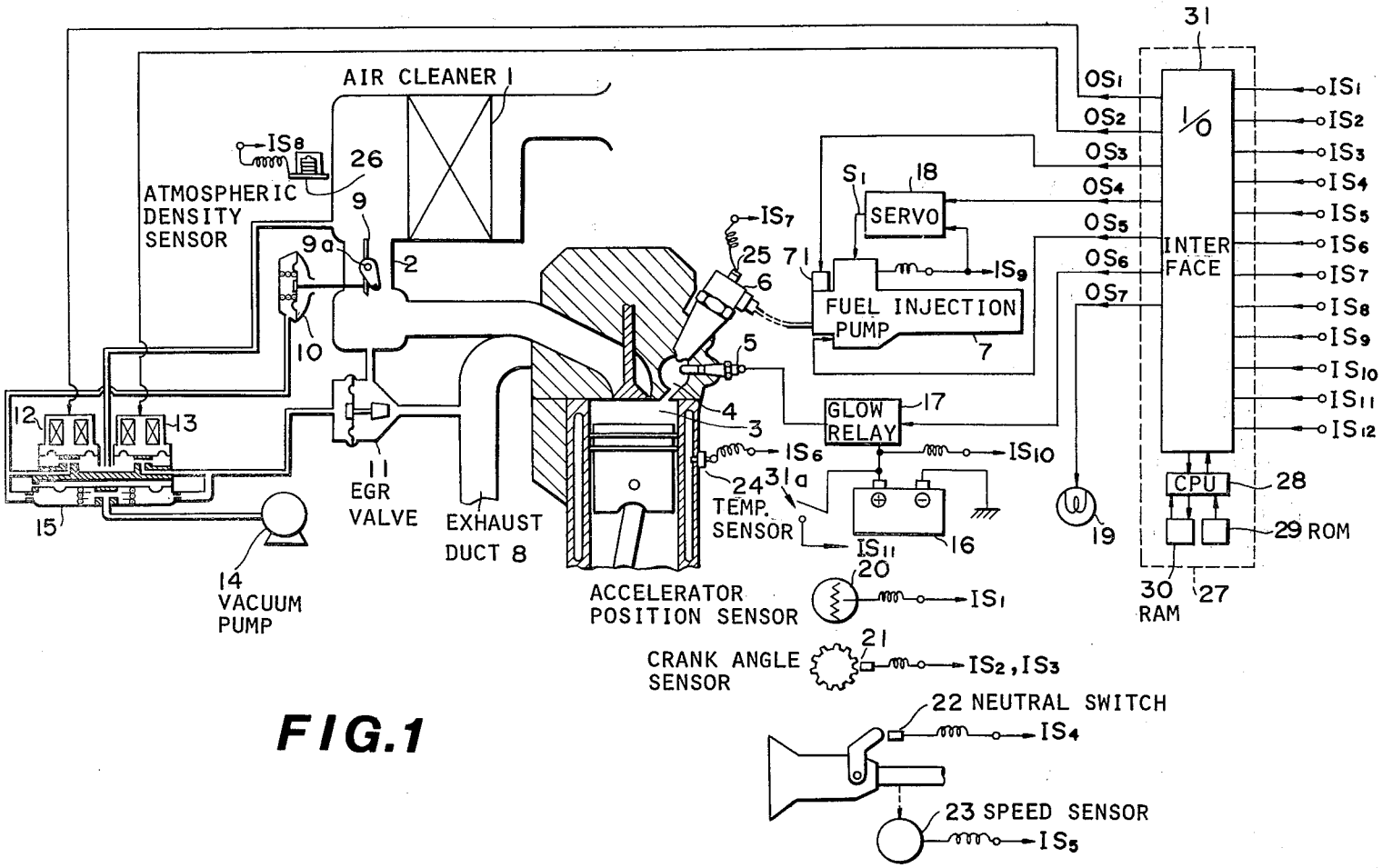
FIG. 1 shows a diagrammatic view of a diesel engine control circuit in which the present invention is employed.

In FIG. 1 of the drawings, intake air is conducted via an air cleaner 1 in an air intake duct 2 to a main combustion chamber 3 of an engine. A swirl chamber 4 is provided with a glow plug 5 to preheat fuel injected from an injection nozzle 6 into the chamber 4. A diaphragm valve 10 controls the opening of a throttle valve 9 controlling the amount of intake air to the engine. An EGR valve 11 controls the amount of EGR (exhaust gas recirculation) from an exhaust duct 8 to the air intake duct 2. A vacuum pump 14 or other vacuum pressure source is connected to a chamber 15 to maintain therein a reference vacuum pressure. Electromagnetic valves 12 and 13 control the connection of the reference pressure to the pressure-actuated diaphragm valve 10 and EGR valve 11, respectively, in order to adjust the actuation pressure derived from the air intake duct 2. For diesel engines, a glow plug relay 17 controls the flow of electric current from a power supply 16 to the glow plug 5. A servo circuit 18 controls the output of fuel from a fuel injection pump 7 to the injection nozzle 6. An indicator lamp 19 indicates the state of supply of electric current to the glow plug 5. An accelerator position sensor 20 outputs a signal $IS_1$ indicative of the position (depression angle) of an accelerator, not shown. A crank angle sensor 21 produces a reference pulse $IS_2$ for each reference crank angle (for example 120° ) rotation, and a unit pulse $IS_3$ for each unit crank angle (for example 1° ) rotation. A neutral switch 22 outputs a signal $IS_4$ when it detects that the transmission is in the neutral position. A vehicle speed sensor 23 outputs a vehicle speed signal $IS_5$ indicative of the vehicle speed, the speed signal being determined by the rotational speed of the output shaft of the transmission. A temperature sensor 24 outputs a temperature signal $IS_6$ indicative of the temperature of cooling water for the engine. A lift sensor 25 outputs a signal $IS_7$ each time the injection nozzle 4 starts to inject fuel, the lift sensor being for example a switch or piezoelectric element actuated by fuel pressure. An atmospheric density sensor 26 outputs a signal $IS_8$ indicative of the atmospheric density determined by the temperature and pressure of the atmosphere. A sleeve position signal $IS_9$ indicates the position of a sleeve, to be later described in more detail, which controls the amount of fuel injected from the injection pump 7. $IS_{10}$ denotes a signal indicative of the battery voltage.

A calculating system 27 comprises, for example, a microcomputer which includes a central processing unit (CPU) 28, a read only memory (ROM) 29, a read/-write memory (RAM) 30, and an input/output interface 31.

The calculating system 27 receives the above-mentioned signals $IS_1$ to $IS_{10}$, a starter signal $IS_{11}$ and a glow signal $IS_{12}$. The starter signal $IS_{11}$ is outputted from the manually operated key or starter switch 31*a* which is closed for operating the starter motor. The glow signal $IS_{12}$ is outputted from a glow switch, not shown, provided in the instrument panel and used to preheat the cylinders before start-up. The calculating system 27 outputs various control signals $OS_1$–$OS_7$ for controlling the diesel engine optimally.

The throttle valve-opening control signal $OS_1$ and the EGR control signal $OS_2$ are pulse signals whose duty cycles control the duty cycles of electromagnetic valves 12, 13, thereby controlling the opening of the throttle valve 9 and the EGR valve 11, respectively, in well-known manners.

The fuel shut-off control signal $OS_3$ controls the operation of a fuel shut-off valve 71 (for stopping the engine) provided in the injection pump 7.

The fuel injection rate control signal $OS_4$ and the sleeve position feedback signal $IS_9$ are supplied to the servo block 18 which outputs a servo signal $S_1$ for controlling the position of the sleeve, and thus, the fuel injection rate. The servo block 18 responds to the feedback signal $IS_9$ to correct the servo signal $S_1$ to match control signal $OS_4$, so that the difference between the feedback signal $IS_9$ and the control signal $OS_4$ will normally stay within a limited range.

The injection timing control signal $OS_5$ controls an injection timing control mechanism provided in the injection pump 7 and therefore fuel injection timing. Injection timing is feedback controlled, using the injection start signal $IS_7$ from the lift sensor 25.

The glow plug control signal $OS_6$ controls the glow plug relay 17 and therefore the supply of electric current to the glow plug 5.

The indicator lamp control signal $OS_7$ controls the turning on and off of the glow plug indicator 19 to thereby indicate whether or not the glow plug 5 is being operated. For example, when the glow plug is being operated, the indicator lamp 19 is lighted while when the glow plug is de-energized, the indicator lamp 19 is turned off.

Fuel Injection Pump

Figure 2:
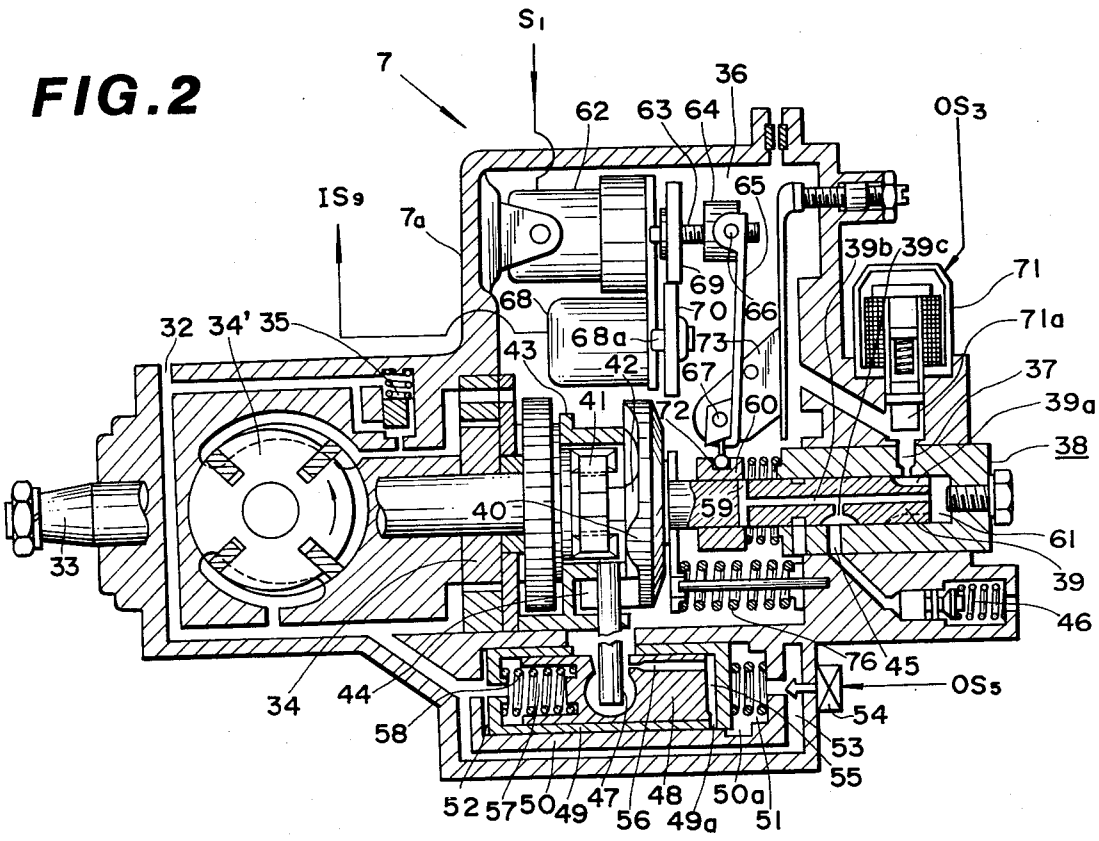
FIG. 2 shows an example of an injection pump used in FIG. 1.

In the injection pump 7 shown in FIG. 2, fuel is drawn into the inlet 32 of the body of a feed pump 34 which is driven by the drive shaft 33 connected to the output shaft, now shown, of the engine. To facilitate understanding of the pump 34, it is shown at 34' as being rotated through 90 degrees. The pressure of the fuel discharged from the pump 34 is controlled by a pressure regulator valve 35 and is then supplied to a pump chamber 36 formed within the pump housing. The fuel enters a high-pressure plunger pump 38 through an inlet port 37. The fuel within the pump chamber 36 lubricates the operating parts of the pump arrangement.

The plunger 39 of the pump 38 is connected to an eccentric disc 40, which is loosely connected through keys 41 to the drive shaft 33 to be driven at a rotational rate proportional to the engine rotation. The eccentric disc 40 has the same number of cam faces 42 as the engine has cylinders, and translates axially, while being rotated, as the individual cam faces 42 pass over rollers 44 disposed along a roller ring 43 which is supported rotatably around the axis of the drive shaft 33, the rollers 44 each being supported pivotably by a respective one of radial shafts, not shown, secured angularly spaced to the roller ring 43, as shown in U.S. Pat. No. 4,177,775. The disc 40 and therefore the plunger are biassed via a push plate 75 by a coil spring 76 against the rollers 44. Thus, when the drive shaft 33 is driven, the plunger 39 rotates while reciprocating. This reciprocal and rotating movement causes the fuel to be drawn into a chamber 61 through an intake port 37 and one of grooves 39*a* provided spaced circumferentially on the plunger 39 aligning with the inlet port 37 and to be forced under pressure through an axial groove 39*b* in the plunger from one of distributing ports 45 provided spaced circumferentially on the plunger 39 aligning with an outlet 39*c* in the plunger through the corresponding delivery valve 46 to the corresponding injection nozzle 6 of FIG. 1. Thus, the plunger 39 regulates the timing and rate of admission of fuel to the respective delivery valves 61 and therefore to the corresponding respective injection nozzles 6.

The timing of fuel injection is regulated by changing the relative position of the cam faces 42 and rollers 44 via rotation of the roller ring 43. This roller ring is connected to a plunger 48 through a drive pin 47. In FIG. 2, for the convenience of description, the plunger assembly is shown rotated through 90 degrees. A cylinder 49 in which the plunger 48 is accommodated is slidably received within a casing 50 and has a pair of hydraulic chambers 51 and 52 on the right-hand and left-hand ends of the cylinder 49. Passageway 49*a* and 50*a* are provided to bring the hydraulic chamber 51 and a high pressure end chamber 55 into communication when the cylinder 49 has moved to the right in the figure. The hydraulic chamber 51 communicates with the other hydraulic chamber 52 and the inlet side of the feed pump 34 through a fuel passageway 53. An electromagnetic valve 54 is provided in a passageway through which the hydraulic chamber 51 can communicate with the fuel passageway 53. The fuel pressure within the pump chamber 36 is conducted through a passageway 56 into the high-pressure end chamber 55 on the right-hand side of the plunger 48 slidable within the cylinder 49. In contrast, a low-pressure end chamber 57 on the opposite side of the plunger 48 communicates with the drawing-in side 32 of the feed pump 34 and is normally at a relatively low pressure. However, the plunger 48 is urged to the right by the force of a spring 58. The fuel pressure within the pump chamber 36 increases in proportion to the rotational speed of the feed pump 34 so that when the passageway 49*a* is closed, as shown, the plunger 48 is pushed to the left in the figure as the engine speed increases. This rotates the roller ring 43 in the direction opposite the direction in which the eccentric disc 40 rotates so that the injection timing advances in accordance with the engine speed.

When the cylinder 49 moves to the right extreme in the figure due to the torque of the eccentric disc 40, and at the same time the electromagnetic valve 54 is open, the hydraulic chamber 51 and the high-pressure end chamber 55 communicate via the passageways 49*a* and 50*a* so that in this case the opening and closing of the electromagnetic valve 54 controls the pressure within the end chamber 55. Thus, the duty cycle of the valve 54, controlled by the injection timing control signal $OS_5$, controls the positioning of the roller ring 43 and thus the injection timing.

A fuel injection rate is determined by the position of a sleeve 60, slidable along the plunger 39, which is capable of covering a spill port 59 provided in the plunger 39. For example, if the opening of the spill port 59 goes beyond the right-hand end of the sleeve 60 due to the movement of the plunger 39 to the right in the figure, the fuel, which has been forced under pressure from the plunger pump chamber 61 through the axial passageway 39b and outlet 39c to the distributing port 45 aligning with the outlet 39c, will be vented into the pump chamber 36 through the spill port 59, thereby circumventing the supply of fuel under pressure.

Specifically, if the sleeve 60 is displaced to the right relative to the plunger 39, the timing of cessation of fuel injection will be retarded so that the fuel injection rate will increase, whereas if the sleeve 60 is displaced to the left relative to the plunger 39, the timing of cessation of fuel injection will be advanced so that the fuel injection rate will decrease.

Of course, the movement of the ignition switch to the position where the starter motor is operated causes the sleeve 60 to move to the start-up injection position. The subsequent positions of the sleeve and therefore the servomotor are controlled by the values read out from a memory table in the ROM 29 in FIG. 1 according to the instantaneous engine speeds and loads.

The control of the sleeve 60 position is carried out by a servomotor 62, supported on the pump housing 7a, which has an outside threaded shaft 63 which is screwed into an inside threaded hole provided at the center of a slider 64, which thereby moves axially in response to rotation of the shaft 63.

Connected pivotally at a pin 66 to the slider 64 is a link lever 65 which is also supported at a pivot 67 of a support 73 and engaged with the sleeve 60 via a pivot pin 72 provided at the end of the link lever 65.

Thus, when the servomotor 62 rotates in one direction or other, the slider 64 moves to the right or left in the figure so that the link lever 65 turns around the pivot 67 in one direction or the other, thereby moving the sleeve 60 to the left or right. The control of the servomotor 62 is effected by the servo signal $S_1$ outputted from the servo circuit 18 according to the fuel injection rate control signal $OS_4$.

Thus, there is no direct correspondence relationship between the depression of the accelerator pedal and the fuel injection rate. That is, the accelerator pedal only acts to transmit the driver's desire to "acceleration" or "deceleration" to the calculating device 27 which calculates an optimal fuel injection rate according to the operating state of the engine at that time and effects a corresponding optimal control according to the fuel injection rate control signal $OS_4$.

A potentiometer 68 is provided in the vicinity of the servomotor 62 and has a shaft 68a which is connected to the shaft 63 of the servomotor 62 through gears 69 and 70 secured to the shafts 63 and 68a, respectively, so that when the servomotor 62 is operated, the gears 69 and 70 are rotated, whereby the potentiometer 68 produces a sleeve position signal $IS_9$ which indicates the position of the sleeve 60.

An electromagnetic fuel shut-off valve 71 is controlled by the fuel shut off control signal $OS_3$ mentioned hereinbefore with respect to its opening and closing. When the signal $OS_3$ indicates a shut-off command, the intake port 37 is closed by a valve member 71a to shut off the supply of fuel, thereby stopping the engine.

Failsafe

Figure 3:
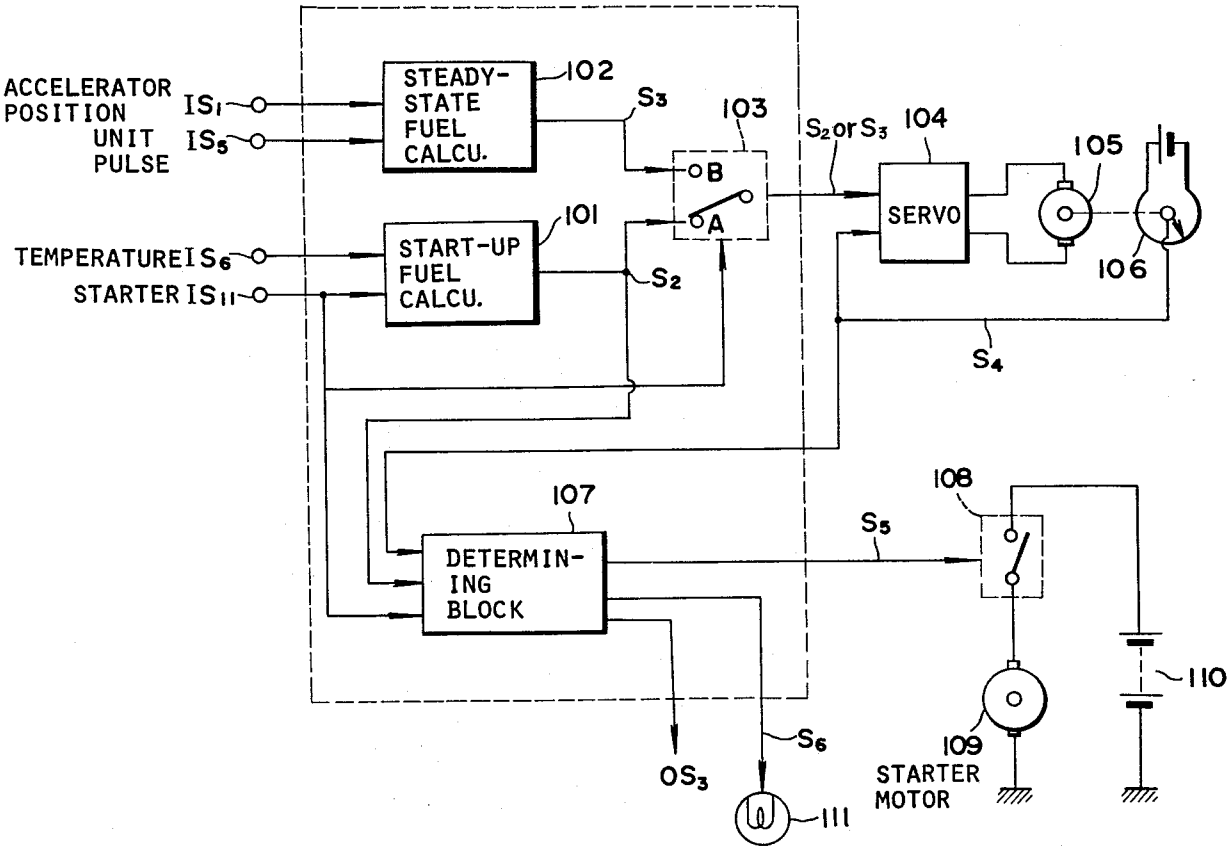
FIG. 3 shows an embodiment of a failsafe system according to the present invention.

FIG. 3 shows a flow diagram of the major calculating steps performed by the calculating system 27. The flow diagram utilizes block-form calculating components for ease of illustrating data flow although it is to be understood that in the preferred embodiment, a digital computer forms the hardware element operating in accordance with the flowcharts of FIGS. 4 and 5.

As shown in FIG. 3, a start-up fuel calculating block 101 outputs a start-up commmand signal $S_2$ only while receiving the starter signal $IS_{11}$. The command signal is indicative of the fuel injection rate employed during engine start-up and is selected in response to the temperature signal $IS_6$. For example, the start-up command fuel quantity may be twice as much as the fuel injected during normal engine operation.

A steady-state fuel injection rate calculating block 102 calculates a steady-state fuel injection rate and outputs a steady-state command signal $S_3$. The value of the command signal $S_3$ is calculated in accordance with the accelerator position signal $IS_1$ and the unit crank-angle pulse $IS_3$ indicative of engine speed.

In both the start-up and steady-state modes of operation, the fuel injection rate may be formed by reference to look-up tables stored in the ROM 29. The details of such calculations are, however, not pertinent to the invention.

A switching block 103 is switched over to the terminal A to conduct the start-up command signal $S_2$ when the starter signal $IS_{11}$ is inputted to the switching block 103. This block 103 is switched over to the terminal B to pass through the steady-state command signal $S_3$ in the absence of the starter signal $IS_{11}$.

A servo block 104, which may be an amplifier, (corresponding to 18 in FIG. 1) controls a servomotor 105 (corresponding to 62 in FIG. 2) so as to match a feedback signal $S_4$ produced by a potentiometer 106 (corresponding to 68 in FIG. 2) to the command signal $S_2$ or $S_3$ (corresponding to $OS_4$ in FIG. 1). The feedback signal $S_4$ (corresponding to $IS_9$ in FIG. 1) indicates the rotational position of the servomotor 105 or the position of the sleeve 60 for controlling the amount of fuel injected.

A determining block 107 compares the start-up command signal $S_2$ with the feedback signal $S_4$ while the starter signal $IS_{11}$ is inputted thereto, and outputs a starter actuation signal $S_5$ when the servo system is functioning properly, i.e., when the difference between the signals $S_2$ and $S_4$ is within a permissible range.

The starter signal $S_5$ turns on a starter actuating switch 108, which connects a starter motor 109 to a battery 110, thereby effecting cranking and starting the engine.

When the difference between the start-up command signal $S_2$ and the feedback signal $S_4$ is not within the permissible range, the determining block 107 recognizes that the servo system is malfunctioning, and outputs an malfunction signal $S_6$ to light a lamp 111, thereby indicating the occurrence of malfunction. The arrangement is also such that the lamp 111 is on from the time the starter switch is turned on to the time the start-up command signal $S_2$ and the feedback signal $S_4$ coincide, and then the lamp 111 is turned off. Thus, it is easy to recognize when the lamp 111 is burned out.

In the circuit of FIG. 3, when the manual operation of the key switch (starter switch) produces a starter signal $IS_{11}$, the start-up command signal $S_2$ adjusts the servo motor 105 to its start position. The starter motor 109 and therefore engine cranking are not started until the start command signal $S_2$ and the feedback signal $S_4$ from the potentiometer 106 coincide. Thus, when the servo control system including the servo block, the servomotor and the potentiometer malfunctions, the engine will be spared wear and damage due to unsuccessful attempts to start.

The arrangement may be such that when the determining block 107 determines that the servo control system malfunctions, the lamp 111 is lit and in addition the fuel shut-off valve 71 shown in FIG. 2 is closed as indicated by the generation of the fuel shut off signal $OS_3$.

In the determining block of FIG. 3, the setting of the fuel injection rate employed during engine start-up and that the operation of the servo control system may be simultaneously checked, or, the arrangement may be such that, first, the operation of the servo control system is checked, for example, by setting the input to the servo block 104 to an appropriate value and after the determination is made that the servo system is functioning properly, the fuel injection rate employed during engine start-up is set.

Figure 4:
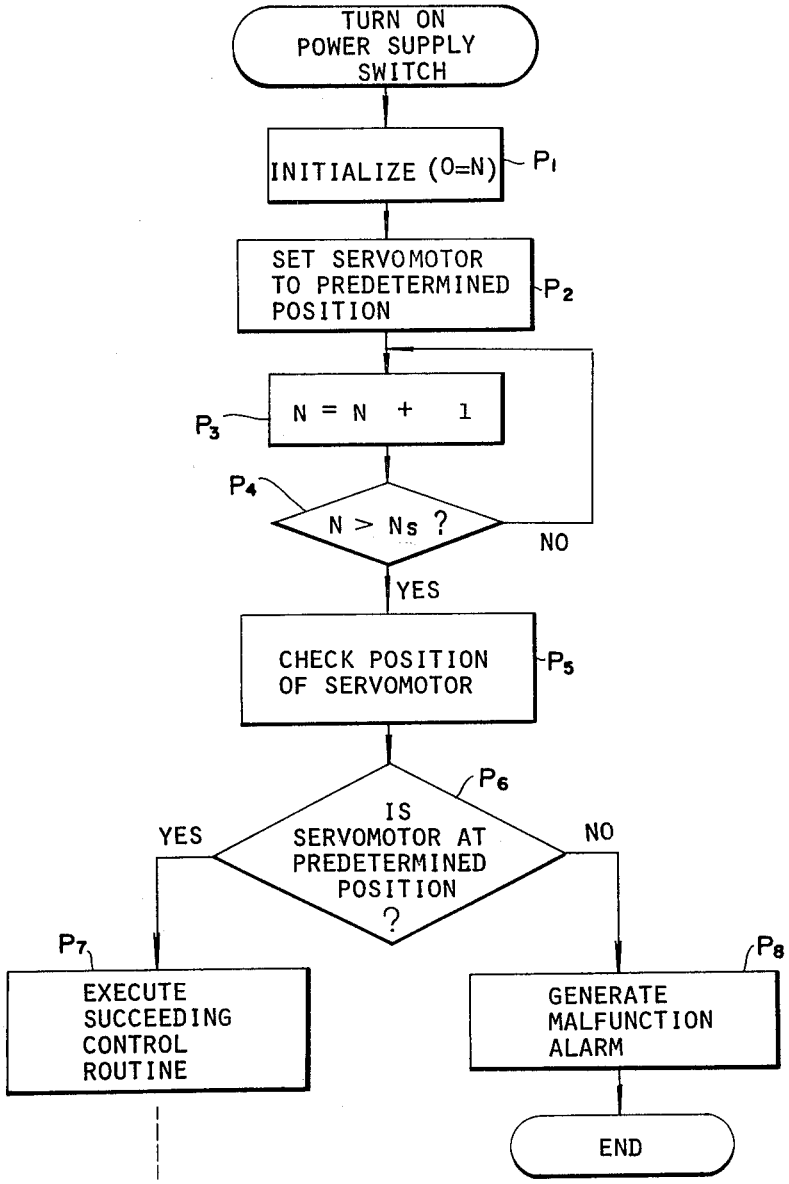
FIGS. 4 and 5 are flowcharts showing the operations of two embodiments of the failsafe system according to the present invention.

FIG. 4 is a flow chart for executing a portion of the control of the circuit portion enclosed by the broken lines in FIG. 3 using a microcomputer. In FIG. 4, the setting of the servo motor for checking its operation and the setting of the fuel injection rate employed during engine start-up are separately carried out. When the driver turns on the power supply switch, not shown, (generally forming part of a switch mechanism which includes the key switch) the computer is initialized at step $P_1$ (e.g. N is set to zero), and then a command signal is outputted for setting the rotational angle of the servo motor 62 to a desired check position (not the start-up position). As a result, the position of the sleeve 60 is set to a predetermined (check system) position at step $P_2$. In order to produce a time delay corresponding to the response time of the servomotor, the computer executes a delay loop for a predetermined time corresponding to the index $N_s$ at steps $P_3$ and $P_4$, and then the program proceeds to step $P_5$.

At step $P_5$, the rotational position of the servomotor is detected using the feedback signal, and, at step $P_6$, the determination is made as to whether the rotational position of the servomotor coincides with the position dictated by the command signal. At step $P_6$, if the determination is YES, the servo system is functioning properly so that the program proceeds to step $P_7$ where the succeeding start control routine is executed, which, for example, sets the position of the sleeve 60 to its initial position, operates the starter motor and thereby starts cranking. At $P_6$, if the determination is NO, which means that the servo system is malfunctioning, the program proceeds to step $P_8$ where the driver is notified of the occurrence of a malfunction by way of lighting the lamp 111. The program then immediately goes to END. Thus, when the servo system malfunctions, the starter motor can not be operated.

Figure 5:
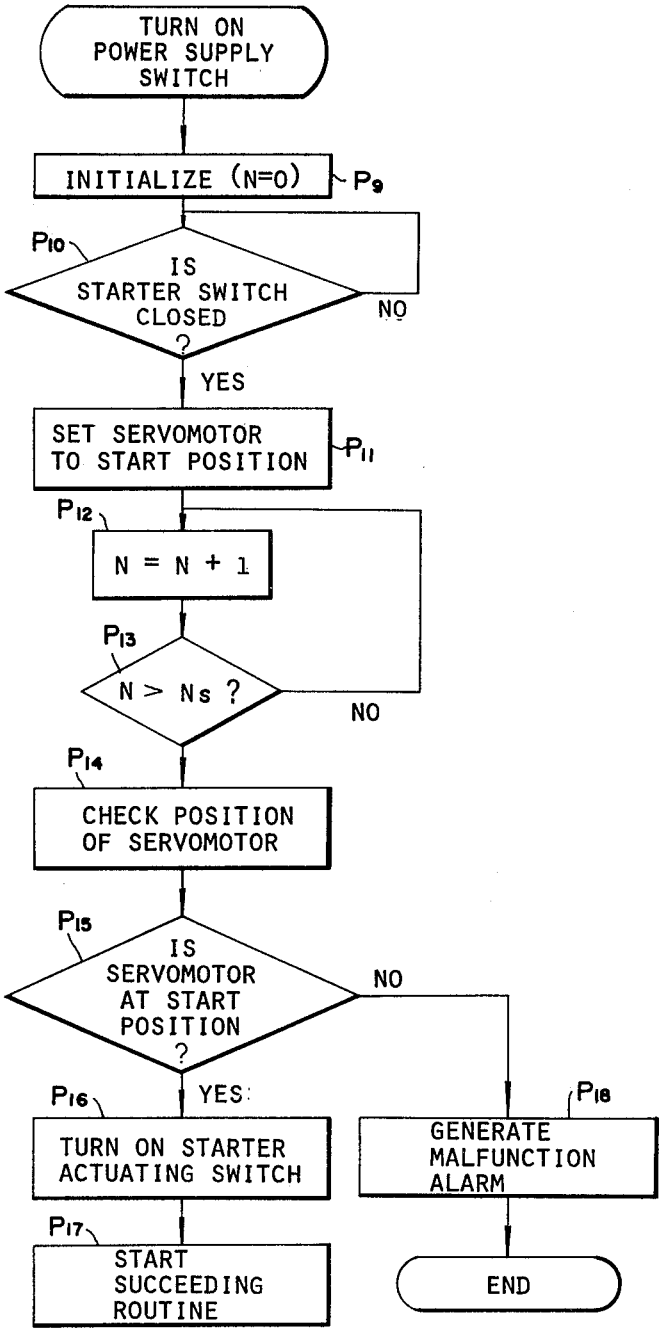

FIG. 5 is another flow chart for executing the present invention using a microcomputer. At $P_9$, after the power supply switch is turned on, the computer is initialized (e.g., N=0). At $P_{10}$, the determination is made as to whether the starter switch 31*a*, which the driver operates to start the starter motor, is on. If the determination at $P_{10}$ is YES, the program goes to step $P_{11}$ where a command is outputted for setting the rotational position of the servomotor to its start position.

At steps $P_{12}$ and $P_{13}$, a predetermined time delay corresponding to count index $N_s$ is produced, and then the program goes to step $P_{14}$ where the rotational position of the servomotor is detected using the feedback signal $S_4$. At $P_{15}$, the determination is made as to whether the rotational position of the servomotor is the start position dictated by the command signal. If the determination at $P_{15}$ is YES, which means that the feedback system is functioning normally, the program goes to step $P_{16}$. In this case, since the servomotor is already set to its initial position, the actuating switch for the starter motor is turned on at step $P_{16}$ to start cranking. The program then goes to $P_{17}$ where the succeeding routine starts.

If the determination at step $P_{15}$ is NO, the program goes to step $P_{18}$ where an alarm is produced, indicating the occurrence of malfunction and the program goes to END.

The routine of FIG. 5 checks at $P_{10}$ for a starter switch signal $IS_{11}$, but the glow plug relay signal $IS_{10}$ may be used instead.

While the operation of the invention has been described in reference to the position as represented by the feedback signal being equal to or coinciding with the position as represented by the command signal, it is clear that a small range of non-equality is permitted and generally desirable to avoid unnecessary hunting.

While the present invention has been described and shown as being applied to a fuel distribution-type pump, it may be applied to an array-type pump such as disclosed in British Pat. No. 1 555 482, by checking the rotational position of the angularly-adjustable throttle member 20.

As described above, according to the present invention, the operation of the servo system is examined immediately before starting of the engine, and only when the servo system is functioning properly, will the engine be started so that when the servo system malfunctions, the starter motor can not be operated. Thus the engine will not be damaged by running at an excessively high speed.

The present invention also applies to the device in which the throttle valve 9 is controlled by a servo system such as shown in FIG. 3, as well as to the device in which the throttle valve of a spark ignition engine is controlled by a servo system.

In these cases, the block diagram of FIG. 3 should be modified such that the blocks 102 and 103 are replaced by a steady-state throttle position calculating block, having as inputs the accelerator position signal $IS_1$ and the unit pulse signal $IS_3$, and a start-up throttle position calculating block, having as inputs the temperature signal $IS_6$ and the starter signal $IS_{11}$, respectively. Thus, the diaphragm valve 10 and the electromagnetic valve 12 should be removed.

While the present invention has been described and shown in terms of a preferred embodiment thereof, it should be noted that the present invention should not be limited to the embodiment. Various changes and modifications could be made by those skilled in the art without departing from the spirit and scope of the invention as set forth in the attached claims.

What is claimed is:

1. A failsafe system for an engine control system which produces a command signal for controlling a controllable device of said engine, said failsafe system comprising:

(a) means for producing a feedback signal indicative of the state of said controllable device;

(b) a controller responsive to the command signal and the feedback signal to control said controllable device so that a difference between said command signal and said feedback signal is within a predetermined range;

(c) a starter motor switch operable for generating a start motor signal for normally operating an engine starter motor;

(d) a sensor for generating a sensor signal indicative of a sensed vehicle parameter and means responsive to the start motor signal and the sensor signal for adjusting said command signal to a value corresponding to optimal engine start-up conditions; and (e) means, responsive to the start motor signal, the feedback signal, and the command signal, for preventing operation of the starter motor when the difference between said command signal and said feedback signal is outside of said predetermined range.

2. A failsafe system as claimed in claim 1, wherein said preventing means also outputs an alarm signal when the start motor signal is received and the difference between said command signal and said feedback signal is outside of said predetermined range.

3. A failsafe system as claimed in claim 1, further including a switching element responsive to the start motor signal for switching the command signal to a start-up value whenever the starter signal is inputted to said switching means.

4. A failsafe system as claimed in claim 1 or 3, wherein said sensor signal is an engine temperature signal.

5. A failsafe system as claimed in claim 4, wherein said command signal determines a start-up fuel injection rate.

6. A failsafe system for an engine control system for controlling a controllable device of an engine, said failsafe system comprising:

(a) means for producing a command signal to set a rotational angle of a servomotor which controls said controllable device to a desired check position;

(b) means for producing a time delay corresponding to a response time of said servomotor;

(c) means for detecting an actual rotational position of said servomotor;

(d) means for determining whether a difference between the actual rotational position of said servomotor and the desired check position is within a predetermined range; and (f) means for preventing said engine from starting when said difference is outside of said predetermined range.

7. The failsafe system of claim 6, further including means for detecting when a starter switch is closed and for generating a starter signal when said starter switch is closed.

8. The failsafe system of claim 7, further including means responsive to said starter signal for setting said check position to a start position.

9. A method of operating a failsafe system for an engine control system for controlling a controllable device of an engine, comprising the steps of:

(a) producing a command signal operable to set a rotational angle of a servomotor which controls said controllable device to a desired check position;

(b) producing a time delay corresponding to a response time of said servomotor;

(c) detecting an actual rotational position of said servomotor;

(d) determining whether a difference between said actual rotational position of said servomotor and said desired check position is within a predetermined range; and (f) preventing said engine from starting when said difference is outside of the predetermined range.

10. The method of claim 9, further including a step of detecting whether or not a starter switch is closed prior to performing step (a).

11. The method of claim 9, wherein said desired check position is set to a start position in step (b) when said starter switch is closed.

* * * * *